United States Patent [19]

Herring, Jr. et al.

[11] 4,192,238

[45] Mar. 11, 1980

[54] RAILWAY CAR DRIVE SYSTEM

[75] Inventors: James M. Herring, Jr., Merion Station; Harry M. Russell-French, Ambler, both of Pa.

[73] Assignee: The Budd Company, Troy, Mich.

[21] Appl. No.: 866,484

[22] Filed: Jan. 3, 1978

[51] Int. Cl.[2] ..... B61C 9/52; B61F 3/04; B61F 5/06; B61F 5/10

[52] U.S. Cl. ..... 105/133; 105/108; 105/135; 105/182 R; 105/197 B; 105/199 R; 267/3

[58] Field of Search ..... 105/108, 133, 171, 182 R, 105/197 B, 199 R, 200, 109, 117, 130, 131, 132, 132.1, 135; 267/3; 308/138

[56] References Cited

U.S. PATENT DOCUMENTS

| | | | |
|---|---|---|---|
| 2,036,194 | 4/1936 | Burrows et al. | 105/132.1 X |
| 2,051,074 | 8/1936 | Burrows et al. | 105/132.1 X |
| 2,051,075 | 8/1936 | Burrows et al. | 105/133 X |
| 2,908,230 | 10/1959 | Dean | 105/200 X |
| 2,922,383 | 1/1960 | Destreicher | 105/131 X |
| 3,013,507 | 12/1961 | Stein | 105/182 R |
| 3,190,237 | 6/1965 | Hurtner | 105/182 R |
| 3,270,691 | 9/1966 | Zoellner | 105/199 R |
| 3,288,083 | 11/1966 | Jones | 105/133 X |
| 3,288,084 | 11/1966 | Schauster | 105/133 X |
| 3,408,954 | 11/1968 | Kademann et al. | 105/135 X |
| 3,919,948 | 11/1975 | Kademann | 105/108 X |

*Primary Examiner*—Joseph F. Peters, Jr.
*Assistant Examiner*—Howard Beltran
*Attorney, Agent, or Firm*—A. L. Trueax, Jr.

[57] ABSTRACT

A railway car includes prime movers mounted to a car body directly connected to pairs of gear boxes to drive pairs of axles mounted on a pair of trucks, with direct connections between the gear boxes and the connections being such so as to permit independent removal of the trucks from the prime movers and to facilitate the installation of interchangeable variable speed drives.

8 Claims, 5 Drawing Figures

RAILWAY CAR DRIVE SYSTEM

Driving means for railway cars have taken a wide variety of different forms in the past. Many such cars have depended upon external sources of electrical power from a third rail, for example. Other cars, such as the cars involved in the present invention, have employed diesel motors to permit the car to be self propelled without any external power. In the latter type cars, it is often desirable to replace either the truck assembly or the prime mover assembly without disturbing the parts in the other assembly.

It is known that trains required to travel relatively long distances generally require higher maximum speeds than trains travelling relatively short distances, such as on commuter runs. In order to minimize the overall costs involved in building such trains capable of both high and low maximum speeds to thereby make them available to smaller municipalities with limited funds, it is desirable to utilize the same basic parts for both types of cars with a minimum number of interchangeable parts required to provide the variable speeds.

In modern railway cars, air conditioning and heating systems require much space. A relatively large space is generally required beneath the floor of the car to accommodate many of the components related to these items. With the drive means and trucks also disposed beneath the floor of the car, providing the necessary space for additional components pose special problems.

In general, trucks used heretofore, especially the structures between the side frames, have presented some problems and have prevented direct connections to facilitate space saving without adversely affecting some other function.

It is an object of this invention to provide an improved drive system for a railway car.

It is a further object of this invention to provide an improved drive system for a railway car in which the driven means and the driving means may be readily detached from each other.

It is still a further object of this invention to provide an improved drive means for a railway car which minimizes the amount of space requirement thereby making floor space beneath the car available for other items.

In accordance with the present invention, a system for driving a rail car includes a pair of trucks for supporting the car body. Each of the trucks includes side frames with structural spider-like arm members extending upwardly inboard therefrom. A pair of axles are secured to each of the trucks with each of the axles supporting a gear box. An interchangeable gear train, which may be changed for different maximum speeds of the rail car, is connected between the gear boxes on the gear box which is disposed closer to the driving means. Driving means, including a diesel engine and torque converter, are mounted to the car body. The drive means is connected by a shaft to the interchangeable gear train. The gear train drives one of the gear boxes directly to drive one of the axles. A drive shaft extends directly from the gear train below the upwardly extending structural arm members to the other gear box to drive the other axle.

Other objects and advantages of the present invention will be apparent and suggest themselves to those skilled in the art from a reading of the following specification and claims, taken in conjunction with the accompanying drawings, in which:

Figure 1:
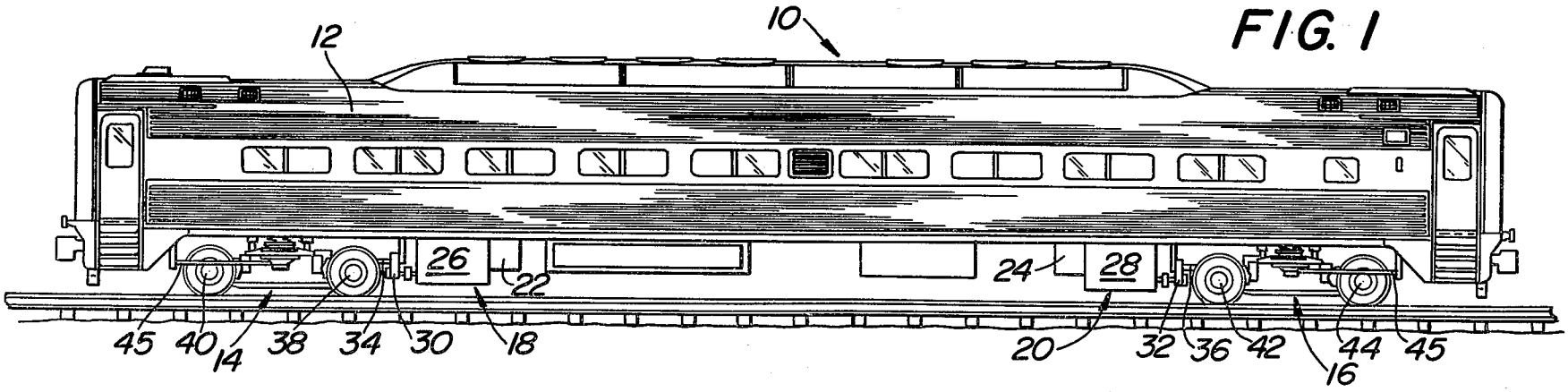
FIG. 1 is a side view of a railway car including the driving mechanisms and trucks, in accordance with the present invention.

Referring particularly to FIG. 1, a railway car 10 includes a car body 12 mounted on a pair of trucks 14 and 16. A pair of driving means 18 and 20 are connected to drive mechanisms on the trucks 14 and 16, respectively. It is noted that the driving means 18 and 20 are relatively close to the trucks 14 and 16 thereby leaving a relatively large space therebetween beneath the floor of the car. Because of the arrangement of the driving means closer to the trucks, more space is available to accommodate other mechanical equipment, such as the means for providing heating and cooling of the car and other apparatus.

The driving means 18 and 20 may include a pair of prime movers, such as diesel engines 22 and 24, respectively. The outputs from the diesel engines 22 and 24 are applied to a pair of torque converters 26 and 28 with the torque converters 26 and 28 being connected to a pair of transmission gear boxes 30 and 32, respectively.

The torque converters are conventional and may include mechanisms relating to gear changing for different speeds of the train, include lock-up capability and other features not directly relating to the subject invention. Multiple gears are included in the transmission gear boxes 30 and 32. These are used to obtain the desired output speeds as well as to provide the output force at the desired heights for the output shafts 34 and 36, the positions of which must take into account the locations of other components in the car.

Output shafts 34 and 36 connect the driving means 18 and 20 to apparatus on the trucks 14 and 16 to drive the axles, such as the axles 38 and 40 and 42 and 44, as will be described in subsequent figures. Anchor rods or stay bars 43 and 45 are connected between the car body and bolster in a well known manner.

In describing the subsequent figures, only the truck 16 and its associated parts will be described, it being understood that the truck 14 and its associated parts are similar in operation.

Figure 2:
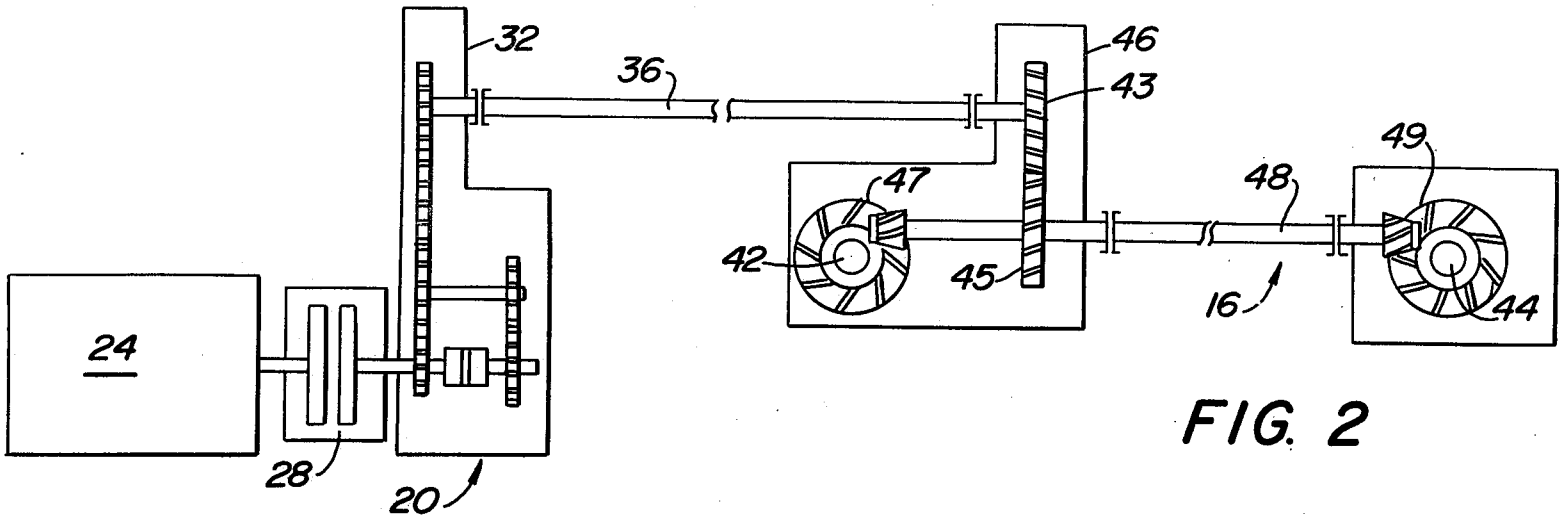
FIG. 2 is a schematic representation of one type of drive system which may be used in the present invention.

Referring particularly to FIG. 2, the prime mover 24, which may be a diesel engine, is connected to a torque converter 28 which may be of the hydraulic type, which is connected to drive the transmission gear box 32. The output shaft 36 connects the transmission gear box 36 with its multiple gear arrangement to an interchangeable gear speed control mechanism 46. The gear mechanism 46 may include a pair of gears 43 and 45. The gear 45 is connected to drive a bevel gear train 47 and the axle 42.

It is desirable in many cases to have the gear mechanism 46 be separate from the mechanism used to drive the axle 42. The gear mechanism may be in a separate housing or within the same housing as the bevel gear 47. The reason for this is that it may be desirable to utilize the same basic parts in a railway car for different high speed trains. Utilizing the feature of interchangeable speed control gear trains, it is merely necessary to insert a gear mechanism 46 with different ratio drives to obtain the desired different speeds. It is noted that the gear assembly 46 is connected intermediate the axles 42 and 46. This arrangement permits the driving assembly, including the diesel engine 24, torque converter 28 and transmission gear box 42, to be disposed close to the truck assembly 16. If the gear assembly 46 were placed intermediate the driving system 20 and the truck asssembly 16, the drive systems illustrated would have to be placed further away from the truck assemblies. This would require the use of floor space beneath the car body 12 which normally could be used for other items such as those related to the air conditioning and heating systems.

A drive shaft 48 is connected from the gear 45 of the gear mechanism 46 to the bevel gears 49 to drive the axle 44. As will be described in connection with FIGS. 3, 4 and 5, it is desirable that this shaft 48 be directly connected between gear assembly 46 to the bevel gear 49 driving the axle 44. This is desirable to minimize the complexity of the mechanical parts involved and to facilitate maintenance or replacement. To accomplish this, the structure between the side frames of the truck must be disposed so as to provide an unobstructed path between the gear mechanism 46 and the gear box including the bevel gear 49.

Figure 3:
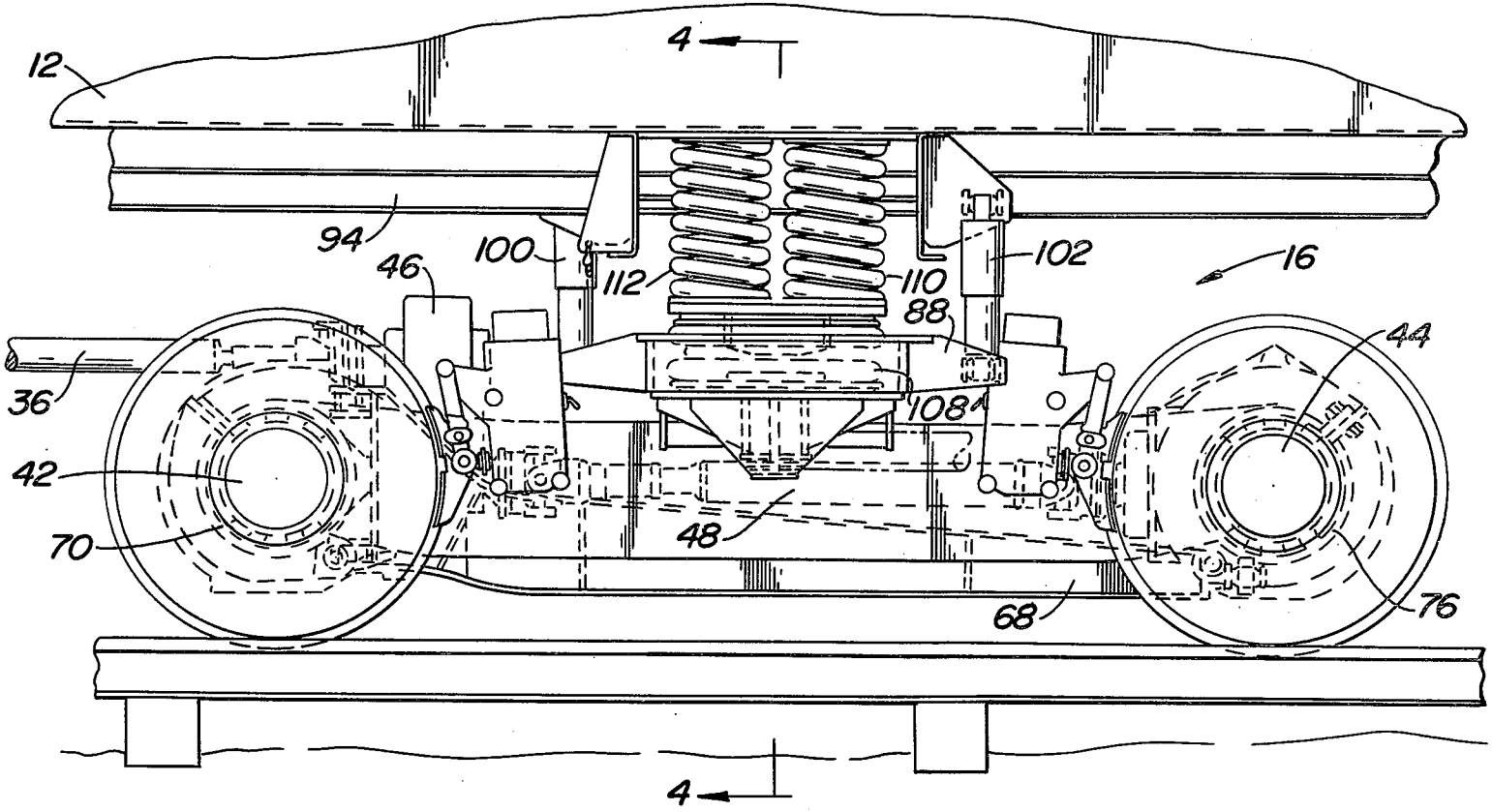
FIG. 3 is a side view of one of the trucks supporting the car body of FIG. 1.
Figure 4:
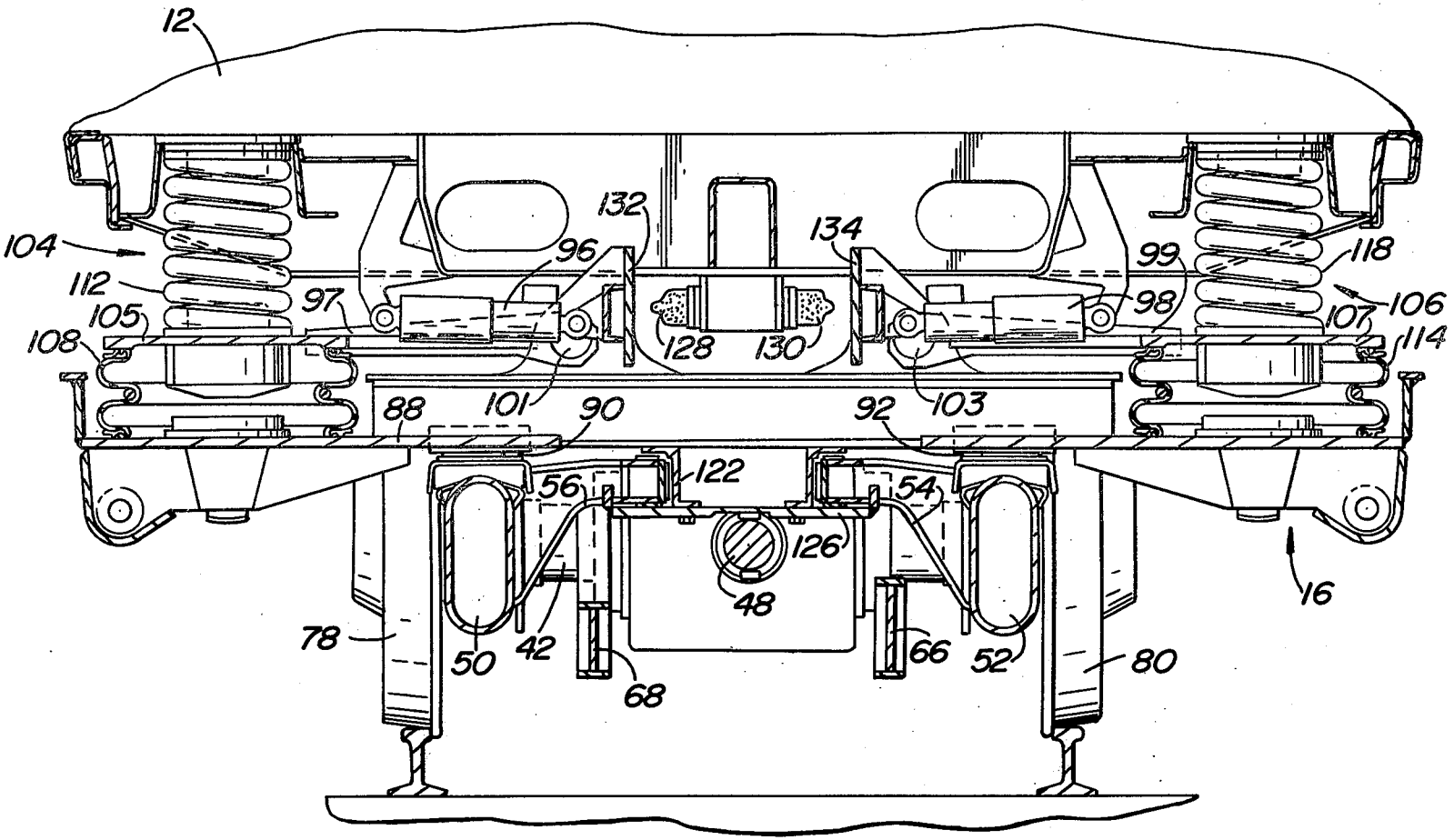
FIG. 4 is a view taken along line 4—4 of FIG. 3.
Figure 5:
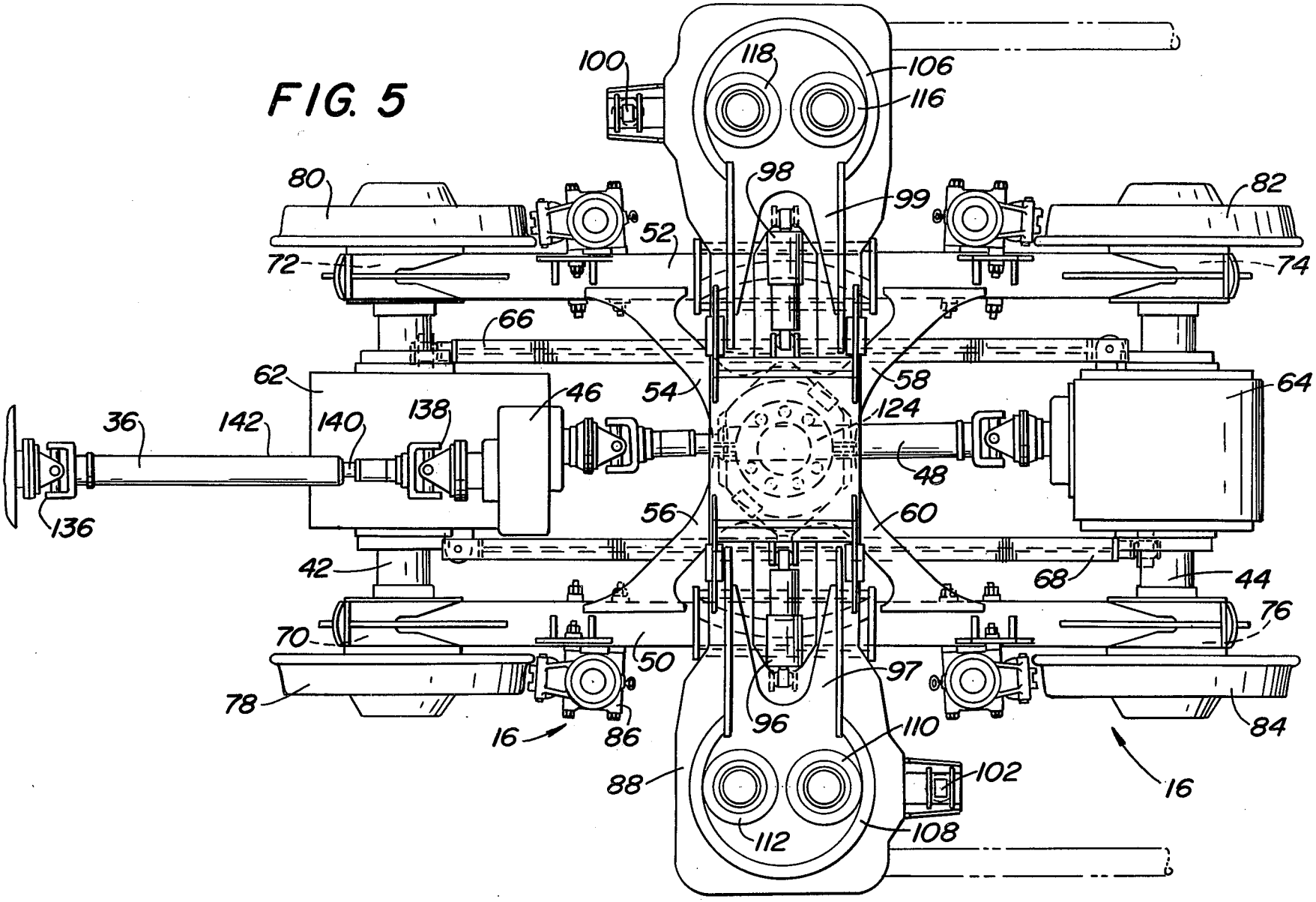
FIG. 5 is a top view of the truck illustrated in the previous figures.

Referring to FIGS. 3, 4 and 5, the truck 16 comprises a pair of side frames 50 and 52 havng a spider-like structure extending therefrom including arms 54, 56, 58 and 60. A truck arrangement including a spider-like structure which has some of the features of the truck illustrated is described in a patent to W. B. Dean, 2,908,230, issued October 13, 1959.

A pair of gear boxes 62 and 64 are mounted to the axles 42 and 44 and include the bevel gears 47 and 49 (FIG. 2) for driving the axles 42 and 44, respectively. The interchangeable gear mechanism 46 is connected to drive the bevel gears 47 within the gearbox 62. In some cases, the gear mechanism 46 may be included in the same box as the bevel gears 47.

A pair of torque arms 66 and 68 are connected between the gear boxes 62 and 64. The torque arms are required to take the reactions resulting from propulsion and engine braking loads.

The axles 42 and 44 are suitably mounted in bearings 70, 72, 74, 76 which are disposed at the ends of the side frames 50 and 52 in a conventional manner.

Wheels 78 and 80 are suitably mounted to the axle 42 and wheels 82 and 84 are mounted to the axle 44. Brake units, such as the brake unit 86, are mounted outboard and disposed to engage the wheels 78, 80, 82 and 84 during a braking operation.

A bolster 88 is supported transversely on the side frames 50 and 52. Slide bearings 90 and 92 are disposed between the bolster 88 and wear plates on the side frames 50 and 52, respectively. The slide bearings 90 and 92 permit the bolster 88 to be turnable or slideable with respect to the truck side frames 50 and 52 about relatively small angles during motion.

Transverse or lateral shock absorbers 96 and 98 are connected between the car body 94 and the bolster 88. Vertical shock absorbers 100 and 102 are also connected between the car body 94 and the bolster 88. The car body bottom structure 94 is supported on the bolster 88 by means of a pair of spring suspensions 104 and 106. The spring suspension 104 comprises an air spring 108 and a pair of mechanical springs 110 and 112. The spring suspension 106 comprises an air spring 114 and a pair of mechanical springs 116 and 118.

A pair of spring planks 97 and 99 are pivoted on the bolster about pivot connections about pivot rods 101 and 103, respectively (FIG. 4). The planks 97 and 99 are connected to plates 105 and 107, respectively which are connected between the pairs of mechanical springs and the air springs. The planks are relatively stiff to accurately control the directions of deflections of the air springs while the mechanical springs are moved slightly in lateral directions.

The bottom of the bolster 88 includes a center pin 122 mounted there to which is adapted to include a generally circular opening 124 provided at the ends of the arms 54, 56, 58 and 60. The center pin 122 is held in place by means of a plate member 126 bolted thereto.

A pair of lateral bumpers 128 and 130 are mounted to the bolster 88 to limit the lateral movement of the car body. Stop members 132 and 134 are connected to the car body to limit lateral movements of the car when they are contacted by either of the bumpers 128 and 130, respectively.

As illustrated in FIG. 4, the arms 54, 56 and 58 and 60, only the arms 56 and 54 being illustrated in FIG. 4, are shaped so that they extend upwardly toward the bottom of the car or bolster. The reason for this is to provide a maximum amount of space for the shaft 48 to permit it to extend from the one gear box, to the other without obstruction in a direct path. The relatively high structural arms also make it possible to connect the center pin 122 of the bolster to the truck. For example, if the arms were very low to permit the shaft 48 to pass over, the connection of the center pin in the circular opening at the ends of the arms would add to the complexity of the center pin connection.

It is noted that the truck 16 may be easily detachable from the drive unit 20 by disconnecting the shaft 36. This greatly facilitates the maintenance requirement when either the driving means or mechanisms within the trucks require maintenance. In addition, interchangeable gear mechanisms 46 make it possible to provide rail cars with different maximum speeds with a minimum amount of change required either in the driving means or in the truck itself. Because of this, it is possible to make rail cars for a variety of speeds in mass production.

Having the gear mechanism 46 within the area between the axles 42 and 44 makes it possible to have the driving means 20 closer to the truck 16. Because of this there is a greater amount of space between the driving means 18 and 20 for the car. Consequently, a relatively large space is provided for additional equipment, which may involve another diesel to produce the heating and air conditioning within the car 10.

It is also noted that the drive shaft 36 between the driving means and the truck is a direct connection. This permits the output shaft 36 to be directly connected to the interchangeable gear mechanism, all within a minimum amount of space.

The shaft 36 is connected at one end to the driving means 20 through a flexible coupling 136. The other end of the shaft 36 is connected to the gear mechanism 46 through a flexible coupling 138. The shaft 36 may be of cardon type, which may include a spline arrangement to permit the element 140 to slide in and out of the exterior housing 142. Such types of flexible coupling to accommodate different angels and distances between two components during operation are well known.

What is claimed is:

1. A system for driving a rail car comprising:
(a) a truck for supporting the car body of said rail car,
(b) said truck including side frames with structural arm members extending inboard therefrom,
(c) first and second axles secured to said truck,
(d) first and second gear mechanisms mounted to said first and second axles, respectively,
(e) a speed control gear mechanism supported directly by said first axle and connected intermediate said first and second axles,
(f) driving means including a prime mover, torque converter and a transmission gear assembly connected to said car body,
(g) a shaft connecting said transmission gear assembly to said speed control gear mechanism,
(h) means for connecting said speed control gear mechanism to said first gear mechanism to drive said first axle, and
(i) a drive shaft extending from said speed control gear below said structural arm members to said second gear mechanism to drive said second axle.

2. A system as set forth in claim 1 wherein said first and second gear mechanisms are housed in first and second gear boxes secured to said shaft connecting said transmission gear assembly and said speed control mechanism, said shaft being positioned over said first gear box to permit said driving means to be disposed relatively close to said truck.

3. A system as set forth in claim 2 wherein said structural arm members extend upwardly from said side frames towards the bottom of said car body to form a central opening at the ends thereof to receive a center pin of a bolster therethrough.

4. A system as set forth in claim 3 wherein said shaft is directly connected through flexible couplings from said transmission gear assembly to said gear train and said drive shaft is directly connected through flexible couplings from said gear train to said second gear mechanism.

5. A system as set forth in claim 4 wherein said prime motor comprises a diesel engine capable of self propelling said rail car free of external power.

6. A system as set forth in claim 5 wherein said speed control gear mechanism is interchangeable with said first gear mechanism to provide means for changing the maximum speed of said rail car.

7. A system as set forth in claim 6 wherein said shaft is detachable from said transmission gear assembly and said speed control gear mechanism to permit said truck to be detached from said driving means and the components of said truck and said driving means remain intact.

8. A system as set forth in claim 7 wherein said transmission gear assembly comprises multiple gears to provide output forces to said shaft at a predetermined height to permit said shaft to be connected in a substantially straight line between said transmission gear assembly and said speed control gear mechanism.

* * * * *